United States Patent [19]

Okouchi et al.

[11] 4,420,038

[45] Dec. 13, 1983

[54] CLEANING SYSTEM FOR HEAT CONDUCTIVE CONDUITS OF A HEAT EXCHANGER

[75] Inventors: Isao Okouchi; Sankichi Takahashi; Yasuteru Mukai; Katsumoto Otake; Takuya Sasaki, all of Hitachi; Masahiko Miyai, Mito, all of Japan

[73] Assignee: Hitachi, Ltd., Tokyo, Japan

[21] Appl. No.: 279,068

[22] Filed: Jun. 30, 1981

[30] Foreign Application Priority Data

Jun. 30, 1980 [JP] Japan ..... 55-89702
Jun. 30, 1980 [JP] Japan ..... 55-89711

[51] Int. Cl.[3] ..... F28G 1/12
[52] U.S. Cl. ..... 165/95; 15/3.51
[58] Field of Search ..... 165/95; 15/3.51, 3.52

[56] References Cited

U.S. PATENT DOCUMENTS 3,021,117 2/1962 Taprogge ..... 165/45 X
3,919,732 11/1975 Honma et al. ..... 165/95 X
4,314,604 2/1982 Koller ..... 165/95

FOREIGN PATENT DOCUMENTS 55-146399 11/1980 Japan ..... 165/95

*Primary Examiner*—Sheldon J. Richter
*Attorney, Agent, or Firm*—Antonelli, Terry & Wands

[57] ABSTRACT

In a cleaning system for heat conductive conduits of a heat exchanger, a great number of balls are circulated through the conduits for mechanically removing incrustations formed on the inner surfaces of the conduits. In order to automatically operate the cleaning system, there are provided with ball counters, one of which counts the number of balls actually circulating the system and the other count the number of balls to be withdrawn out of the system or replaced with new balls because of worn out or breakage. The number of balls circulating is always maintained at a certain level necessary for effective cleaning by a controller which actuates various valves to maintain the number of balls in response to the signal generated by the ball counters.

5 Claims, 6 Drawing Figures

CLEANING SYSTEM FOR HEAT CONDUCTIVE CONDUITS OF A HEAT EXCHANGER

The present invention relates to a cleaning system for cleaning heat conductive conduits of a heat exchanger and, more particularly, to a cleaning system which employees deformable bodies such as resilient balls for cleaning inner surfaces of heat conductive conduits in a heat exchanger.

Generally, in a heat exchanger, for ensuring a high heat exchanging performance, it has been proposed in, for example, U.S. Patent 3,882,931, to use resilient balls, such as, for example, foam rubber balls or sponge balls to mechanically remove incrustations formed on the inner surfaces of the heat conductive conduits by forcing the balls, in rubbing contact with the inner surfaces of the conduits, to pass through the conduits under the pressure of coolant. In a cleaning system of the aforementioned type, certain numbers of balls must be maintained and circulated within a circulating loop so as to sufficiently clean the conduits, and it is necessary to judge whether the number of balls circulated is at a predetermined value. Also, it is necessary to removed worn out or broken balls from the circulating loop and replace them by new balls. However, as the circulating loop is a closed loop, it is difficult to count the number of balls circulating in the loop and also difficult to detect and replace the worn out or broken balls during the cleaning operation.

It is, therefore, an object of the present invention to provide a cleaning system, in which the number of balls to be circulated and to be replaced by new balls is automatically controlled.

According to one feature of the present invention, there is provided a cleaning system for cleaning conduits by circulating resilient balls through the conduits to mechanically remove incrustation formed on the inner surface of the conduits, in which the number of circulating balls are automatically maintained at a predetermined value, while defective balls such as worn out or broken balls are replaced with new ones. The number of balls is advantageously maintained by a means for detecting and taking the defective balls out of the system and a means for supplying the same number of new balls as the number removed.

According to another feature of the present invention, the number of balls can be counted by pressure sensors provided along the inner surface of ball passages. The pressure sensor is capable not only of counting the number of balls passing therethrough, but also detecting the defective balls, because the received pressure by the pressure sensor varies in response to the size or diameter of the balls. However, it is possible for the number of balls to be counted by any other ways such as, for example optical sensors provided along the ball passages or ultra-sonic sensors.

Figure 1:
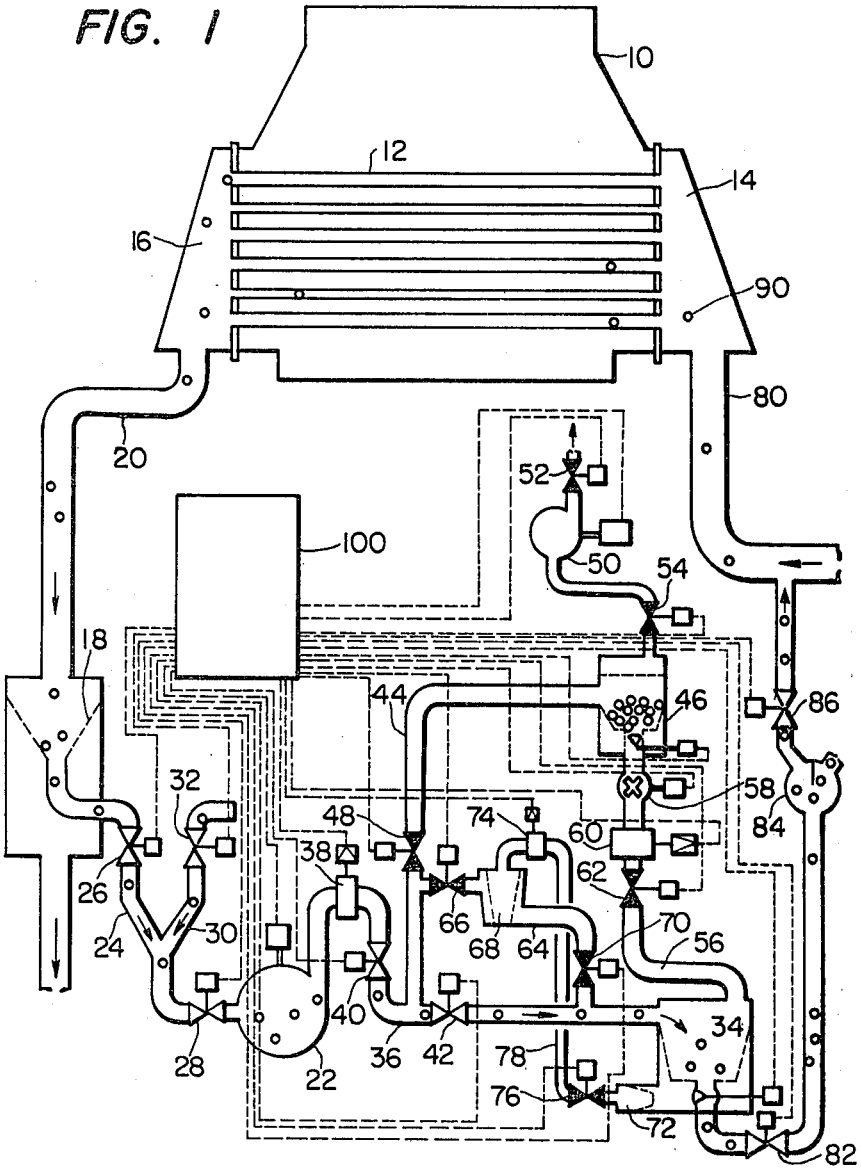
Figure 2:
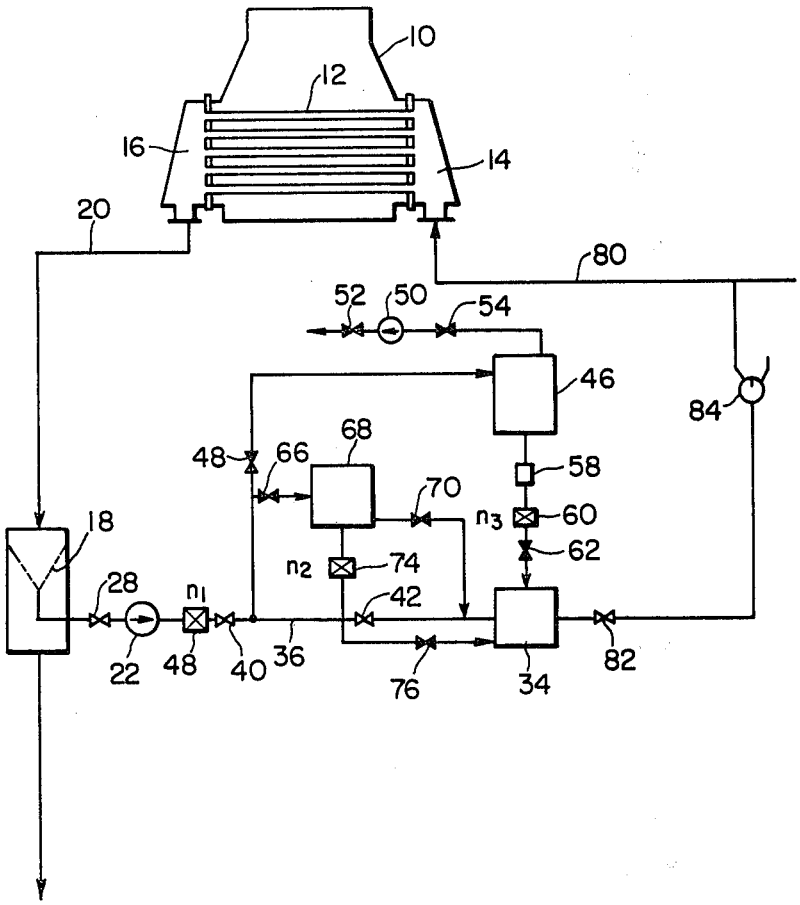
Figure 3:
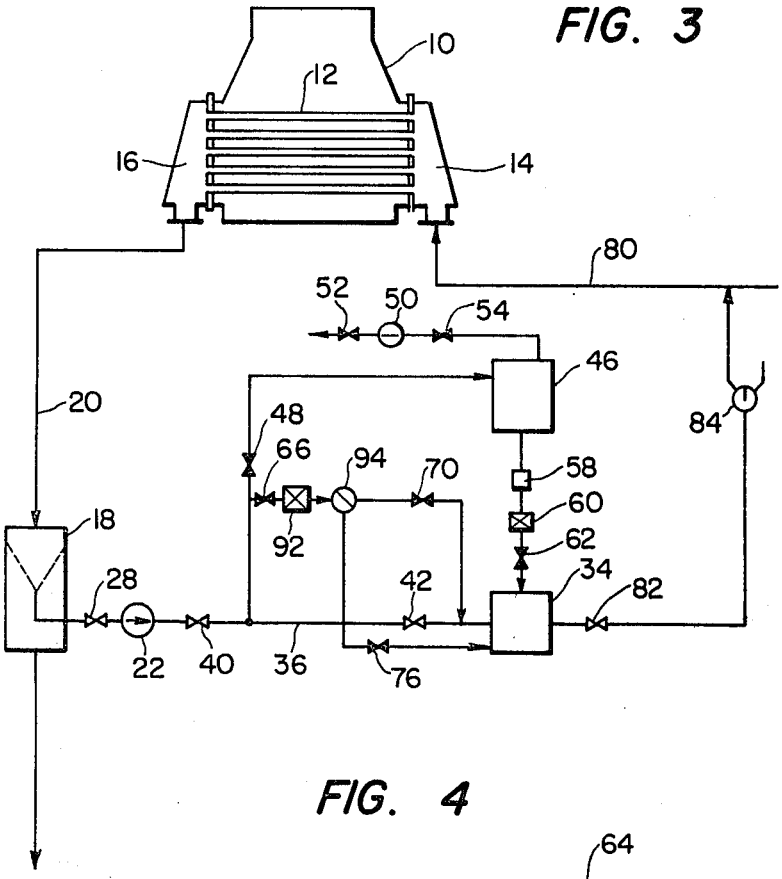
Figure 4:
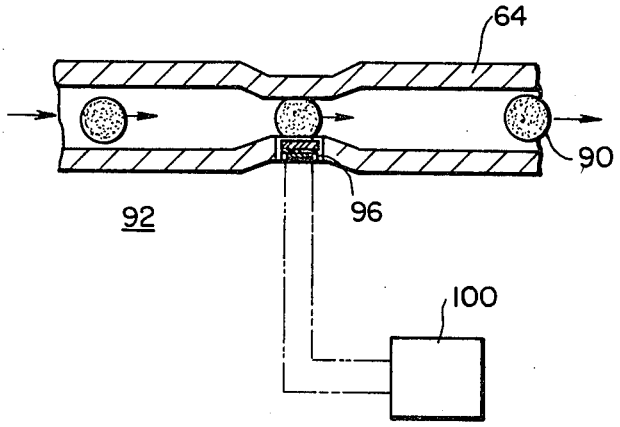
Figure 5:
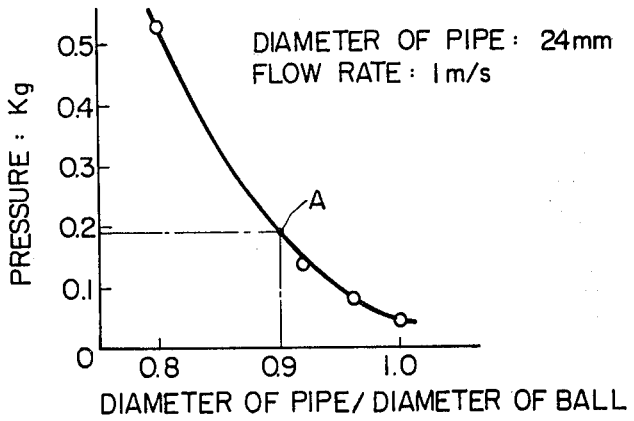
Figure 6:
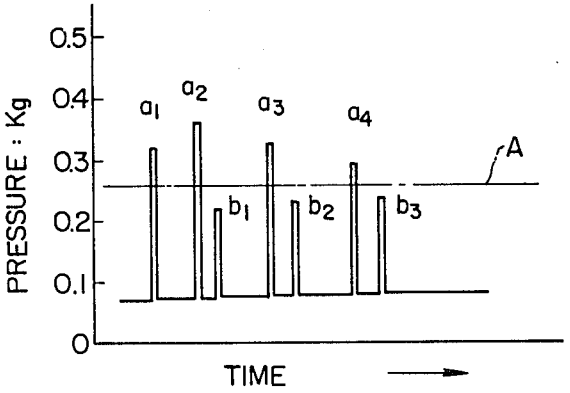

FIG. 1 is a schematic view of a cleaning system according to one embodiment of the present invention, FIG. 2 is a schematic flow diagram of the cleaning system shown in FIG. 1, FIG. 3 is a schematic flow diagram of a cleaning system according to another embodiment of the present invention, FIG. 4 is a diagrammatical view of a ball counter according to one embodiment of the present invention, FIG. 5 is a graphical illustration of a relationship between a received pressure and diameter of the ball, and FIG. 6 is a graphical illustration of pressure pulses generated by the ball counter.

Referring now to the drawings wherein like reference numerals are used throughout the various views to designate like parts and, more particularly, to FIGS. 1 and 2, according to these figures, a heat exchanger 10 has a plurality heat conductive conduits 12, with respective ends of the conduits being connected to an inlet water chamber 14 and an outlet water chamber 16. The outlet water chamber 16 is connected to a trap 18 through a cooling water circulating pipe 20. A downstream side of the trap 18 is connected to a pump 22 by a pipe 24 through valves 26 and 28. Another pipe 30, with a valve 32, is joined to the pipe 24 between the valve 26 and 28. The outlet of the pump 22 is connected to a ball collector 34 by a pipe 36 through a ball counter 38, valves 40 and 42. A bypass pipe 44, is connected to the pipe 36 between the valve 40, 42 and is introduced to a ball impregnator 46 through a valve 48. A vacuum pump 50, with valves 52 and 54, is connected to the ball impregnator 46. The outlet of the ball impregnator 46 is connected to the ball collector 34 by a pipe 56 through a ball feeder 58, a ball counter 60 and a valve 62. A pipe 64 is connected to the pipes 44 and 36 through a valve 66, a ball selector 68, and a valve 70. The selected balls, i.e., worn out balls, are introduced to a ball gathering portion 72 of the ball collector 34 through a ball counter 74 and a valve 76 by a pipe 78. The outlet of the ball collector 34 is connected to a cooling water circulating pipe 80, communicating with the water inlet chamber 14, through a valve 82, a ball distributor 84 and a valve 86.

The resilient balls 90 circulating the conduits 12 are sucked at the trap 18 from the cooling water circulating pipe 20 by the action of the pump 22 so that the water, including the balls 90 is, introduced into the pipe 36. The balls 90 are normally circulated within a closed loop through the pipe 36, the ball collector 34, the distributor 84, and the pipe 80 into the inlet chamber 14, wherein the valves 48, 52, 54, 62, 66, 70 and 76 are closed. When the valves 66, 70 and 76 are opened, the worn out or broken balls can be selected by the ball selector 68. The normal balls are returned through the pipe 64 and the valve 70 into the inlet of the ball collector 34. The number of the worn out or broken balls separated by the selector 68 are counted by the ball counter 74. The worn out or broken balls are stored in the ball gathering portion 72 and thereafter withdrawn from the circulating system. The balls 90 passing the pipe 44 are fed into the ball impregnator 46, where the balls are impregnated with water, then introduced into the ball collector 34 through the ball feeder 60 and the ball counter 62.

The number of balls 90 passing through the respective ball counter 38, 60 and 74 are counted thereby and signals of respective counters are fed to a controller 100, where the number of balls 90 necessary for the cleaning operation is calculated, with the controller 10 respectively generating control signals for the control of the pump 22, ball collector 34, ball selector 68, ball impregnator 46, vaccum pump 50, ball feeder 58 and valves 26, 28, 32, 40, 42, 48, 52, 54, 62, 66, 70, 76, 82 and 84.

The ball counters 38, 60 and 74 are optical counters which are located along the pipes for optically counting the number of balls 90 passing through the pipes. Some other type of counter may be employed such as using strain gages or the like which sense the existance of balls passing the pipe through the pressure change. The ball selector 68 is fashioned as a conical cylinder which is formed with a plurality of holes. Only the worn out or broken balls going around the ball selector 68 can pass through the holes and be selected from the normal balls 90. The ball impregnator 46 has a function promptly drawing air out of balls and impregnating the balls 90 with water with the aid of the vacuum pump 50.

The ball feeder 58 has a rotary impeller which functions to feed each ball to the ball counter 60 in order to aid in an accurate counting operation. The ball collector 34 has a function to temporarily store the worn out or broken balls selected by the ball selector 68 at the ball gathering portion 72. It is preferable that the ball collector is easily readily accessible to enable a removal of the stored worn out or broken balls.

The operation of the present cleaning system will be described with reference to the FIGS. 1 and 2.

(a) Startup

A plurality of balls are poured into the ball impregnator 46. The controller 100 operates to start the pump 22 and opens the valve 48 so that water flow is drawn into the impregnator 46. The valve 48 is then closed. The valves 52 and 54 are opened and the vacuum pump 50 is operated to impregnate the balls 90 with water. The valve 54 is then closed and the valves 48 and 62 are opened. The ball feeder 58 is operated to feed necessary number of balls 90 into the ball collector 34 through the ball counter 60.

(b) Cleaning

The balls 90 poured into the ball collector 34 are circulated in the conduits 12 through the pipes 80 and 20 with the aid of the pump 22 and recovered in the trap 18 and circulated to the ball collector 34 through the pipe 36 after cleaning of the conduits 12. The number of balls circulating are counted by the ball counter 38.

(c) Selecting

The valves 66, 70 and 76 are opened and the valve 42 is closed so that the balls 90 are introduced to the ball selector 68, where the worn out and broken balls are selected and fed to the gathering portion 72 while counting the number of the worn out balls by the counter 74. The normal balls 90 are collected in the ball collector 34. The total number of the normal balls is $n_1$-$n_2$, where $n_1$ is the number of balls 90 counted by the counter 38 and $n_2$ is the number of balls 90 counted by the counter 74. Then, a number of balls equal to the number of worn out or broken balls $n_2$ are supplied to the ball collector 34 by operating the ball feeder 58 while counting the number of balls $n_3$ by the ball counter 60 until $n_3$ becomes equal to $n_2$. In this manner, the same number of balls as the number withdrawn are suppled and the necessary total number of balls $n_1$ are maintained.

CL (d) Water Impregnation

In the case where air is confined in the balls 90, the valve 42 is closed and the valves 48 and 62 are opened to feed all the balls circulating in the system into the impregnator 46. Then the valves 48 and 62 are closed and the startup noted above is once again carried out.

FIG. 3, provide an example of another embodiment which differrs from the embodiment in FIGS. 1 and 2 in that a ball counter 92 and a rotary valve 94 are provided instead of the counter 48, 74 and the ball selector 68. The ball counter 92 is capable of selecting and counting the number of worn out or broken balls at the same time. The rotary valve 94 selectively passes the worn out or broken balls into the gathering portion 72 of the collector 34 through the valve 76 and the normal balls into the collector 34 through the valve 70 in response to the detected signals by the counter 92. As shown in FIG. 4, the counter 92 includes a pressure receiving sensor 96 disposed in the wall of the pipe 64 in a manner so as to have pressure receiving surfaces thereof facing to the pipe 64. The pressure receiving sensor 96 is made of a thin plate such as a metal or semiconductor strain gauge capable of detecting pressure changes caused by a changes in the size or diameter of the balls 90. The detected pressure signals represent not only the number of balls 90 passing through the sensor 96 but also indicate the diameter or the size of the balls 90. The inside diameter of the pipe 64, where the pressure receiving sensor 96 is attached is narrower than the diameter of the balls 90 so that the elastic force exerted upon the pressure receiving sensor 96 due to the deformation of the ball 90 when this ball 90 passes therethrough can be adjusted. More specifically, if the diameter of the pipe 64 in the area of the receiving sensor 96 is equal the diameter of the balls 90, the output of the pressure receiving sensor 96 is capable of being varied in dependence upon the diameter of the ball 90 so that the size or diameter of the ball 90 can be discriminated by presetting the level of that output and so that the peaks higher and lower than a predetermined value can also be simultaneously counted. As a result, after the selection of the defective balls, a distributor such as rotary valve 94 or the like discharges the defective balls out of the system, with the rotary valve 90 being controlled so that only the normal balls 90 can be easily returned to the ball collector 34.

FIG. 5 graphically illustrate the test results of the received pressure which is converted from the output of the pressure receiving sensor 96 in a situation wherein the diameter of the pipe 64 and the mean flow rate in the pipe 64 are preset at 24 mm and 1 m/s, respectively, and the diameter of the balls 90 is variable between 24 mm to 30 mm. The received pressure is descreased as the diameter of the balls decreased. The diameter of the balls 90, which can sufficiently exhibit the cleaning effect, is designated at point A which represents the limit in this particular case for enabling a cleaning operation by the balls 90. As shown in FIG. 6, the peak pulses when the balls pass appear for different diameter of balls. It can therefore be understood that the pulses $a_1$, $a_2$, $a_3$ and $a_4$ are higher than the preset level of A and the pulses $b_1$, $b_2$ and $b_3$ are lower than the preset level A. Control signals are generated to the controller 100 for discharging the worn out balls out of the system when the level of the pulses are lower than the preset level A.

The detection of the balls 90 can also be accomplished by ultra-sonic sensors provided along the ball passages.

What we claim is:

1. A cleaning system for cleaning conduits by circulating resilient balls through the conduits to mechanically remove any incrustations formed on the inner surfaces of the conduits, the cleaning system comprising:

circulating means having an inlet connected to one end of the conduits and an outlet connected to another end of the conduits for circulating the balls through the conduits, detecting means for detecting defective balls from among circulating balls and for removing the defective balls out of the circulating means, said detecting means comprising a first counting means capable of selecting and counting the number of defective balls, means for supplying new balls into said circulating means including a second counting means for counting the number of new balls supplied by said supplying means, third counting means for counting the number of balls circulating in the circulating means, and control means for controlling the number of balls circulating by adjusting the number of balls removed by said detecting means and the number of new balls supplied by said supplying means whereby the number of balls circulating is maintained at a predetermined level.

2. A cleaning system for cleaning conduits by circulating resilient balls through the conduits to mechanically remove incrustations formed on the inner surfaces of the conduits, the cleaning system comprising:

circulating means having an inlet connected to one end of the conduits and an outlet connected to another end of the conduits for circulating the balls through the conduits, detecting means for detecting defective balls from among circulating balls and for removing the defective balls out of the circulating means, said detecting means comprising a selecting means for selecting the defective balls in the circulating balls and first counting means for counting the number of defective balls selected by said selecting means, supplying means for supplying new balls into said circulating means including second counting means for counting the number of new balls supplied by said supplying means, third counting means for counting the number of balls circulating in the circulating means, and control means for controlling the number of balls circulating by adjusting the number of balls removed by said detecting means and the number of new balls supplied by said supplying means, said control means being adjusted in response to values counted in the first and second counting means whereby the number of balls circulating is maintained at a predetermined level.

3. The cleaning system according to one of claims 2 or 1, wherein said control means controls the number of balls circulating in response to detected values by said first, second and third counting means.

4. A cleaning system for cleaning conduits by circulating resilient balls through the conduits to mechanically remove incrustations formed on the inner surfaces of the conduits, the cleaning system comprising:

circulating means having an inlet connected to one end of the conduits and an outlet connected to another end of the conduits for circulating the balls through the conduits, detecting means for detecting defective balls from among the circulating balls and for removing the defective balls out of the circulating means, said detecting means comprising a first counting means for selecting and counting the number of the defective balls, said first counting means comprises a pressure detector for detecting the defective balls by pressure changes caused by the balls and for selectively passing the defective balls in response to the pressure changes so as to count the number of detective balls, means for supplying new balls into said circulating means including second counting means for counting the number of new balls supplied by said supplying means, and control means for controlling the number of balls circulating by adjusting the number of balls removed by said detecting means and the number of new balls supplied by said supplying means, whereby the number of balls circulating is maintained at a predetermined level.

5. The cleaning system according to one of claims 4, 2 or 1, wherein said second counting means comprises a detector which optically detects the existance of balls and counts the number of balls passing therethrough.

* * * * *